US006564691B2

(12) United States Patent
Butler

(10) Patent No.: US 6,564,691 B2
(45) **Date of Patent: *May 20, 2003**

(54) SEMI-AUTOMATIC GAS-OPERATED SHOTGUN

(76) Inventor: Lawrence V. Butler, 8430 E. Montebello, Scottsdale, AZ (US) 85250

( * ) Notice: Subject to any disclaimer, the term of this patent is extended or adjusted under 35 U.S.C. 154(b) by 0 days.

This patent is subject to a terminal disclaimer.

(21) Appl. No.: 10/071,140

(22) Filed: Feb. 6, 2002

(65) Prior Publication Data

US 2002/0139241 A1 Oct. 3, 2002

Related U.S. Application Data

(63) Continuation-in-part of application No. 09/624,410, filed on Jul. 24, 2000, now Pat. No. 6,347,569.

(51) Int. Cl.[7] ..... F41A 5/18
(52) U.S. Cl. ..... 89/191.01; 42/16
(58) Field of Search ..... 42/16, 17, 69.02, 42/69.03, 20, 21, 14, 15; 89/191.01, 191.02

(56) References Cited

U.S. PATENT DOCUMENTS 3,680,433 A * 8/1972 Tollinger ..... 42/17
3,960,053 A * 6/1976 Conley ..... 89/149
6,044,580 A * 4/2000 Gussalli Beretta ..... 42/17
6,347,569 B1 * 2/2002 Butler ..... 42/16

* cited by examiner

*Primary Examiner*—Michael J. Carone
*Assistant Examiner*—Gabriel S Sukman
(74) *Attorney, Agent, or Firm*—Gregory J. Nelson

(57) ABSTRACT

A semi-automatic, gas-operated shotgun having a side-loading port, lower barrel configuration with bottom shell ejection. Gas exit ports on the barrel operate a piston which actuates a connecting rod assembly rearwardly. The rearward movement of the connecting rod assembly will compress a recoil spring and cycle the next shell into the chamber from a shell space in the carrier above the breech. The bolt assembly has upper and lower bolt members. Locking lugs on the opposite sides of the lower bolt are released by rearward movement of the upper bolt member. Shell guide retainer pins are located on the lower bolt member to assist in removing a spent shell. The modular trigger assembly has a hammer which is rotated rearwardly by the lower bolt and which returns to a "short lock time" position held ready to fire by a sear. The barrel has extensions to stop the front of the shell from passing through and out the bottom ejection port upon loading and to guide and help deliver the shell into the barrel chamber.

13 Claims, 18 Drawing Sheets

SEMI-AUTOMATIC GAS-OPERATED SHOTGUN

CROSS REFERENCE TO RELATED APPLICATION

This application is a continuation-in-part of application Ser. No. 09/624,410 entitled "Semi-Automatic Gas-Operated Shotgun" filed Jul. 24, 2000, now U.S. Pat. No. 6,347,569.

FIELD OF THE INVENTION

The present invention relates to a firearm and more particularly to a semi-automatic, two-shot, gas-operated shotgun.

BACKGROUND OF THE INVENTION

Semi-automatic shotguns are popular with sportsmen who engage in competitive shooting such as clay target shooting. Browning firearms introduced a two-shot Browning double-automatic shotgun in about 1955. This gun was an inertia/recoil operated two-shot having a standard top barrel configuration with a loading port on the bottom left side and an ejection port at the top right side.

Ljutic Industries offered a two-shot gas-automatic shotgun called the "Ljutic Bimatic." This shotgun had a standard top barrel designed with a gas system and a recoil spring surrounded by the fore end. A second shell is loaded from the bottom by pulling down on the carrier.

U.S. Pat. No. 3,389,487 to Benelli shows a shotgun having a cartridge loading mechanism with a cartridge magazine in the stock rather than under the barrel which is said by the inventor to improve the balance of the gun. The shotgun has two pivotally connected sections which, through relative pivotal movement, raise cartridges one at a time into firing position.

The early patent to Brondby, U.S. Pat. No. 2,223,671 shows an automatic or semi-automatic firearm of the gas reloading type in which part of the gas is passed through a channel into the barrel into a gas cylinder where it operates a piston and also the ejection and reloading mechanism to perform the ejecting and reloading after each shot.

U.S. Pat. No. 3,631,621 shows an automatic recoil actuated shotgun having a spring-loaded magazine in the stock and the carrier in the receiver which lifts the shells into alignment with the barrel to permit the bolt to move the shell into the barrel for firing.

U.S. Pat. No. 3,919,800 shows a side-loading firearm which is provided with a mechanism associated with a tubular magazine that mates with the barrel. The side-loading opening insures that there is always a cartridge visible through the opening when the gun is loaded to capacity, but that the loading opening is always free for quick reloading when there is room in the magazine. The magazine includes a carrier for lifting cartridges from the loading aperture into the chamber in cooperation with a plurality of latch and stop means to control the timing of the carrier member.

Thus, from the foregoing, it is obvious that there are many automatic and semi-automatic shotguns in the prior art which are operated by gas and recoil spring system. In addition to the above, similar features can be found in such shotguns as the Remington 11-87 and 1100, the Beretta 390 and 391, the Browning Gold Auto and various models by Fabarms, Benelli and others.

There nevertheless exists a need for an improved gas-operated shotgun having unique features which render it reliable, balanced and particularly suited for clay target shooting.

BRIEF DESCRIPTION OF THE INVENTION

Briefly, the present invention relates to a shotgun which is a two-shot shotgun having a side-loading port, lower barrel configuration and bottom ejection. The first shell is inserted into the loading port and is transferred into the breech and the next shell is inserted into the loading port and rests in the carrier shell space above and rearwardly of the breech. At an intermediate location, the barrel has a plurality of gas exit ports spaced around the barrel which communicate with a gas chamber housing a piston. Gas resulting from the firing of a shell will vent from the barrel entering the chamber and actuating the piston to drive a connecting rod assembly rearwardly to cycle the ejection of the empty shell. The connecting rod assembly operates against a recoil spring and will cycle the next shell into the chamber from the carrier.

A bolt assembly having an upper bolt member and a lower bolt member is positioned in the lower portion of the receiver having a shell extractor on its bottom. The spent shell is ejected from the bottom of the shotgun through the ejection port or by fixed shell retainer pins on the face of the lower bolt which retainer the spent shell cartridge in engagement with the extraction as the bolt moves rearwardly. This is facilitated either by two reciprocal pins on the bottom of the bolt assembly that extend forwardly to receive the shell from above and which retract to allow the spent shell to eject cleanly through the ejection port. Twin locking lugs are located on the opposite sides of the lower bolt member and engage locking lug seats on the barrel. The lugs are released by the rearward movement of the upper bolt member which is forced rearwardly by the connecting rods actuated by the gas piston. The rods operate against the resistence of a recoil spring extending around a tube on a carrier assembly.

The trigger mechanism is unique and has a hammer which is pivoted rearwardly to a cocked position as the bolt moves rearwardly. As the bolt returns under the force of the recoil spring, the hammer is allowed to pivot approximately 45° before engaging the sear. The hammer is then in a ready-to-fire position closer to the firing pin for a faster lock time.

The firing pin is driven through a bore in the lower bolt by the hammer. A firing pin block prevents premature automatic firing of a subsequent shell before the locking lugs on the lower bolt are substantially engaged.

Another aspect of the shotgun of the present invention is its modular component assembly. The carrier assembly has its own removable frame as does the trigger mechanism. This is in contrast to most existing semi-automatic shotguns which combine the trigger and carrier mechanisms into a single unit.

BRIEF DESCRIPTION OF THE DRAWINGS

The above and other unique features of the invention will be better understood from the following description, claims and drawings in which:

DETAILED DESCRIPTION OF THE DRAWINGS

GENERAL DESCRIPTION—FIGS. 1, 2, 3, 4, 5 AND 9

Figure 1:
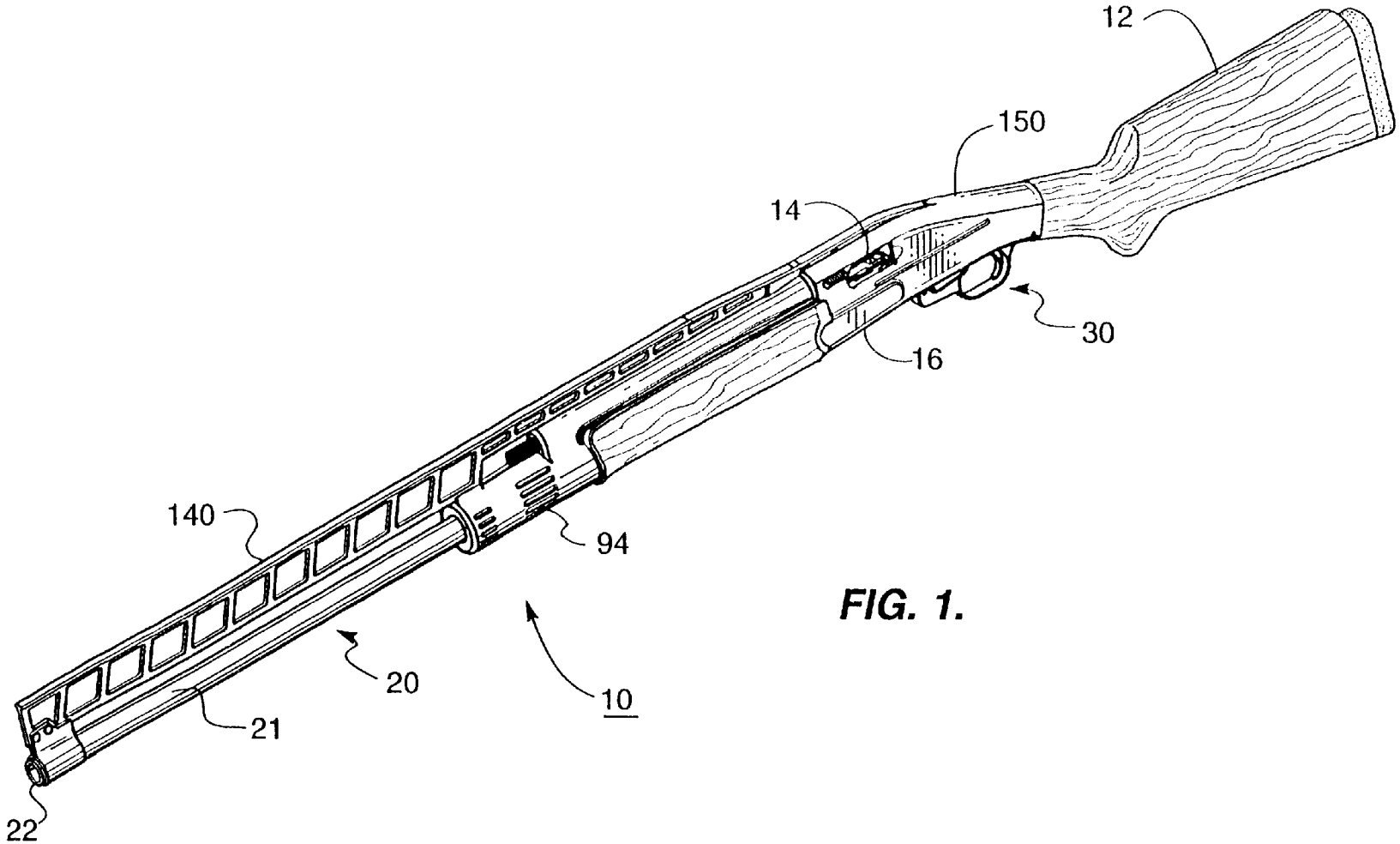
FIG. 1 is a perspective view of the shotgun of the present invention.
Figure 2:
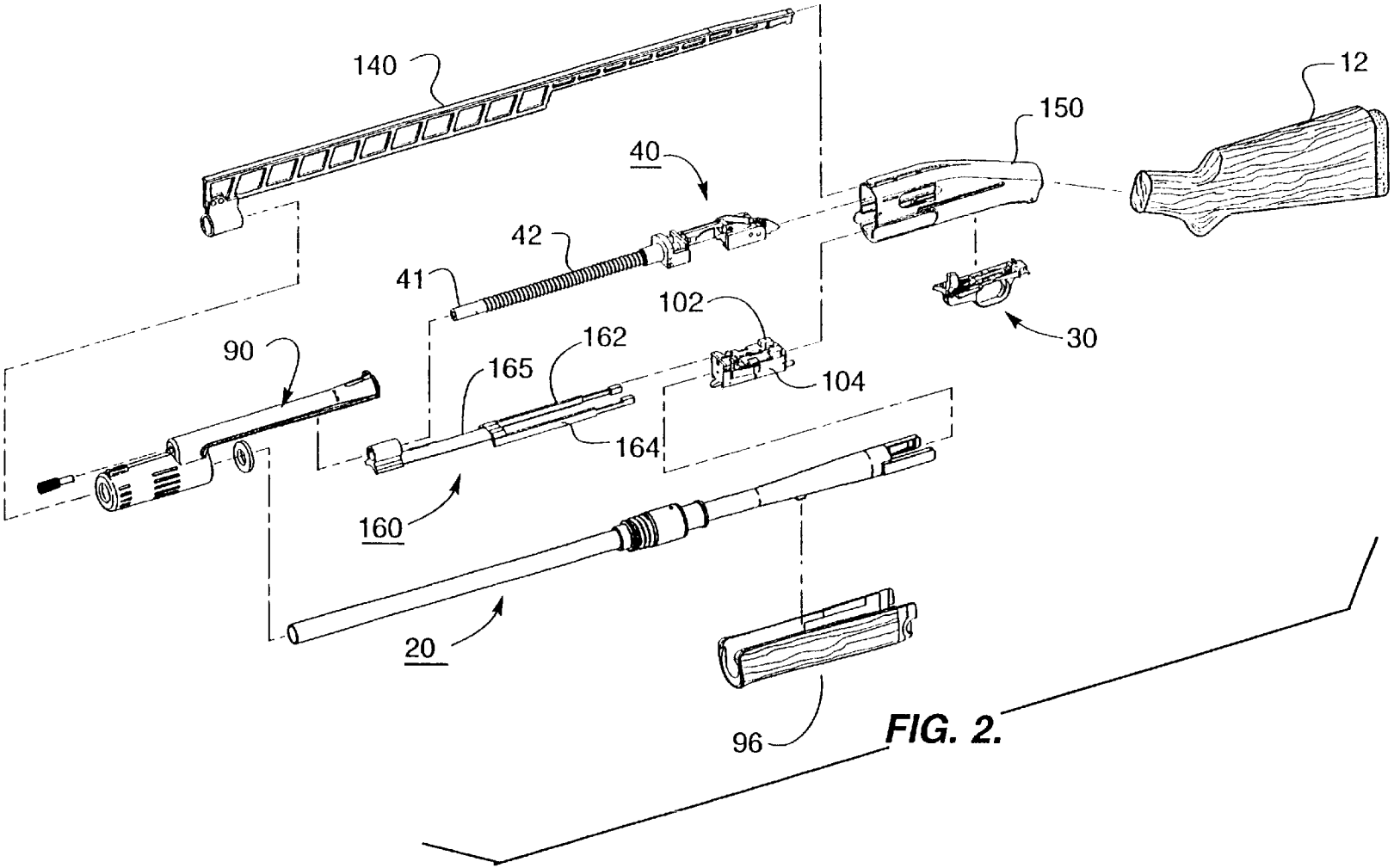
FIG. 2 is an exploded view showing the various components and sub-assemblies of the shotgun of the present invention.

Turning now to the drawings, particularly FIGS. 1 and 2, briefly, the shotgun is generally designated by the numeral 10 and includes a stock 12 which supports a receiver 150.

It is noted that the drawings illustrate a left-handed loading shotgun, it being understood that a shotgun according to the present invention for a right-handed shooter will be the mirror image of that shown. The receiver 150 has a side-loading port 14 and a lower ejection port 16. The receiver receives the proximal end of the barrel assembly 20 within the lower portion of the receiver. A part of the carrier assembly 40 is also housed within the receiver and carries a forwardly extending recoil tube 41 about which extends the recoil spring 42. A connecting rod assembly 160 has a curved body 165 which extends longitudinally along the recoil spring tube 41. A pair of rods 162, 164 extend rearwardly terminating at lugs 163 engage recesses 132 in the opposite sides of the upper bolt member 102 of bolt assembly 100.

A forearm assembly 90 has a frame 95 and a cover 91 that extends over the recoil spring and section 165 of the connecting rod assembly. The cover 91, also seen in FIG. 3, has a vented tubular sleeve 94 which extends around the barrel. A trigger assembly 30 is housed in its own removable frame on the bottom of the receiver carrying the hammer 31 and sear 35. A rib 140 extends longitudinal along the top of the barrel for sighting and aiming.

Figure 12:
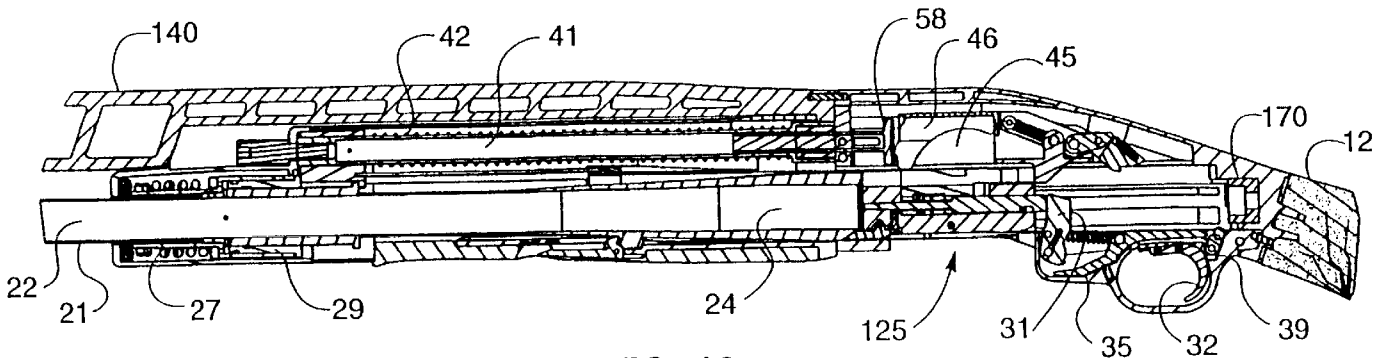
FIG. 12 is a partial longitudinal cross-section of the shotgun.

The above is a general overview of the major components of the shotgun of the present invention. The structure, function and relationship of each of these and other components is 10 discussed in detail below. General reference is also made to FIG. 12 which shows a cross-section view of the assembled shotgun.

Figures 6, 6A:
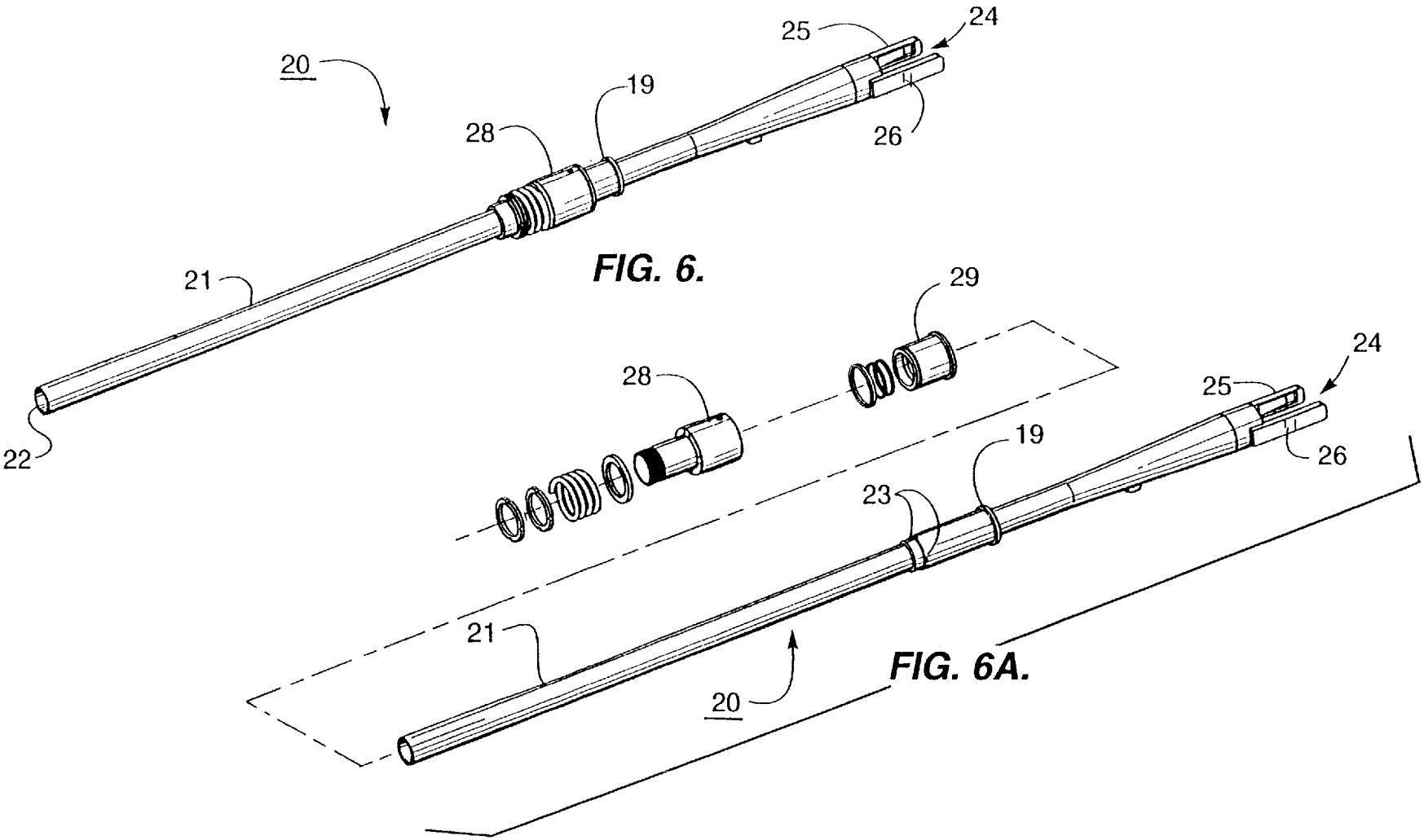
FIG. 6 is a perspective view showing the barrel assembly.
FIG. 6A is an exploded view of the barrel assembly.

Barrel Assembly—FIGS. 6 & 6A

The barrel assembly 20 is identified in FIG. 2 by the numeral 20 and is shown in detail in FIGS. 6 and 6A. The barrel assembly 20 includes a longitudinally extending barrel 21 having a suitable bore 22 depending upon the gauge of the shotgun. The rear of the barrel defines a breech 24 which receives a shot shell when the shotgun is loaded. A pair of rearwardly extending locking lug seats 25, 26 are provided which, when the shotgun is assembled, are engaged by locking lugs 110 on the lower bolt member 104, as will be explained below. The barrel tapers outwardly having increased material thickness along its inner end in the area of the breech.

Located at an intermediate location along the barrel are a plurality of gas ports 23 which are shown as being equally spaced about the circumference of the barrel. An annular gas cylinder housing 28 extends about the barrel in the area of the gas ports 23. The cylinder houses annular gas piston 29 which is reciprocal within a piston chamber of the cylinder housing. Recoil spring 42, operating on the connecting rod assembly, normally urges the piston 29 forwardly into the piston chamber. The terms "forward" or "forwardly" refer to a direction toward the end of the barrel and the terms "rear" or "rearwardly" as used herein refer to a direction toward the stock 12.

Upon a shot shell being fired, gas generated by the explosion will travel down the bore behind the shot and gas will exit through the ports 23 causing the piston 29 to rapidly move rearwardly to a position abutting the annular stop 19 located on the barrel. As will be more fully explained below, the rearward movement of the piston will drive the connecting rod assembly 160, FIG. 9, rearwardly causing the rods 162, 164 to drive the upper bolt member 102 rearwardly.

BOLT ASSEMBLY—FIG. 7

Figure 7:
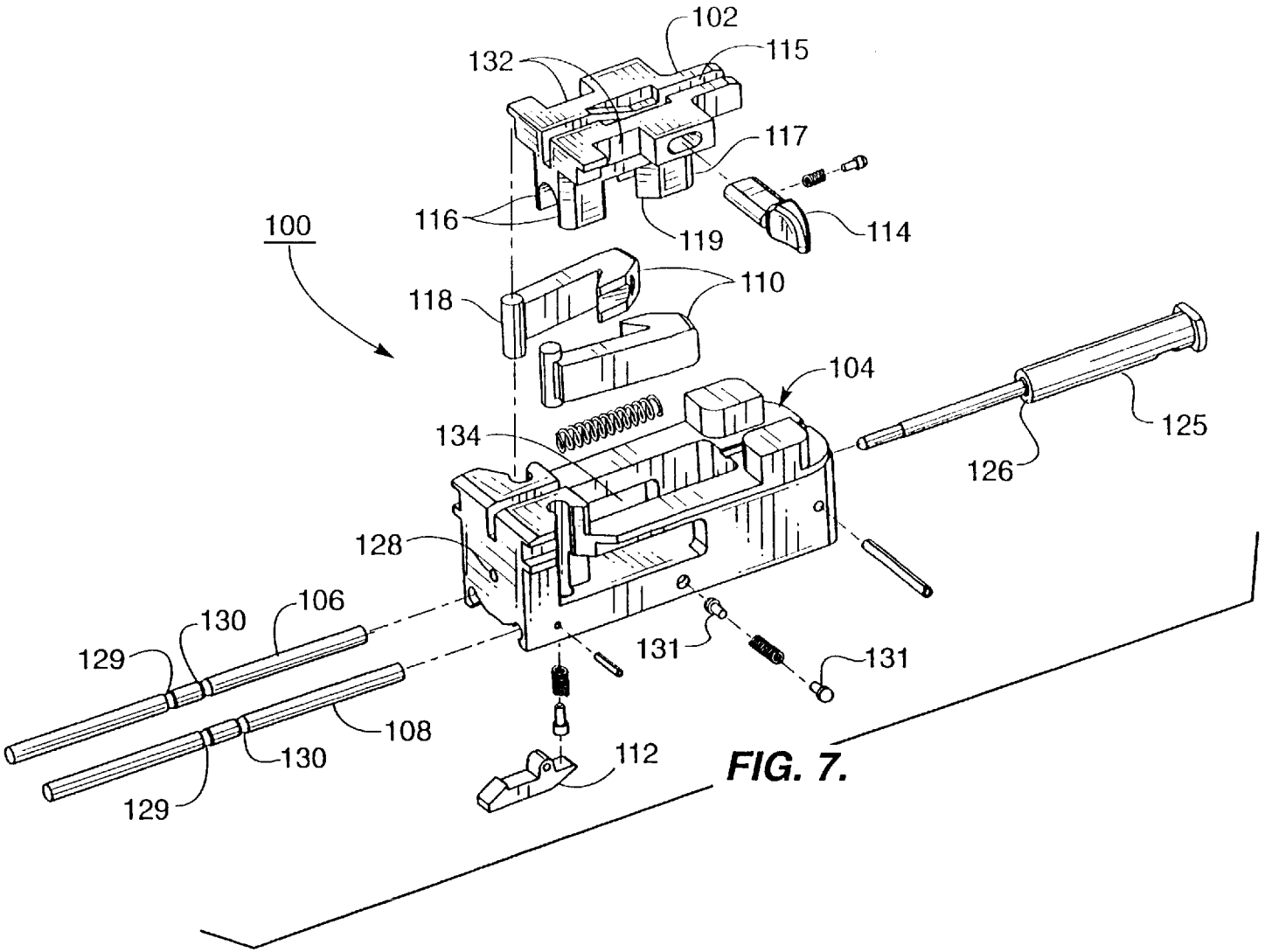
FIG. 7 is an exploded view showing the bolt assembly.
Figure 8:
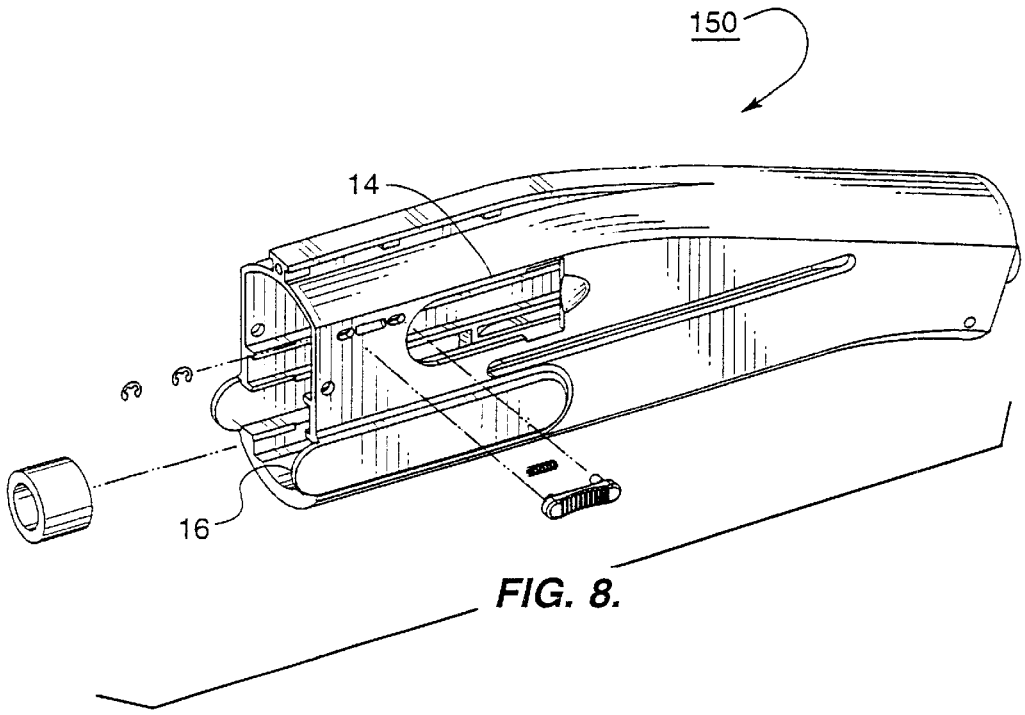
FIG. 8 is an exploded perspective view of the receiver.

The details of the bolt assembly 100 are best seen in FIG. 7. The bolt assembly includes an upper bolt member 102 and a lower bolt member 104. A firing pin 125 extends axially through a bore 128 in the lower bolt member and is aligned with the center of the barrel. The firing pin 125 has a shoulder 126 at an intermediate location to limit its travel. A pair of shell guide pins 106, 108 are reciprocally positioned along the opposite sides of the lower bolt member 104 having a length greater than the axial length of the lower bolt member portion. Each pin has a pair of spaced-apart annular grooves 129, 130 which cooperate with spring-loaded detents 131 in the lower bolt member 104 to limit the reciprocal travel of the pins.

A pair of locking lugs 110 are pivotally mounted at opposite sides of the lower bolt member 104. An extractor 112 is pivotally mounted to the lower portion of lower bolt member 104. Cocking lever 114 is attached to the upper bolt member 102 so that the upper and lower bolt may be manually drawn rearwardly.

The upper bolt member 102 defines a longitudinal slot 115 in its upper surface to accommodate the ejector. The forward end of the upper bolt member has pair of legs 116. Legs 117 depend from the rear of the upper bolt member. Depending legs 116, 117, define cam surfaces 118, 119, respectively, which operate to cause the lugs 110 to disengage and engage.

Recesses 132 in the upper bolt member receive the ends of the connecting rods 162, 164. As the upper bolt member moves rearwardly, the surface 118, 119 will cam the inner surface of the opposed locking lugs 110 on the lower bolt member 104 causing them to pivot inwardly and disengage from the barrel locking lug seats 25, 26. The engagement of the lugs in seats 25, 26 maintains the lower bolt member face 105 against the shot shell and barrel chamber in the firing position. Once the locking lugs are released, the lower bolt member 104 is free to move rearwardly once as legs 117 reach the rear of slot 134 in the lower bolt member. The upper and lower bolt members 102, 104 travel rearwardly as a unit. As the lower bolt member 104 reaches the rear of the receiver, the pins 106, 108 in the lower bolt member will strike cushion 170 at the back of the receiver causing the pins to be pushed forward. The bolt then stops in its rearward position. The bolt assembly 100 will then be caused to be driven forward under spring force of the recoil spring 42 acting against the connecting rod assembly 160.

Figures 4, 4A:
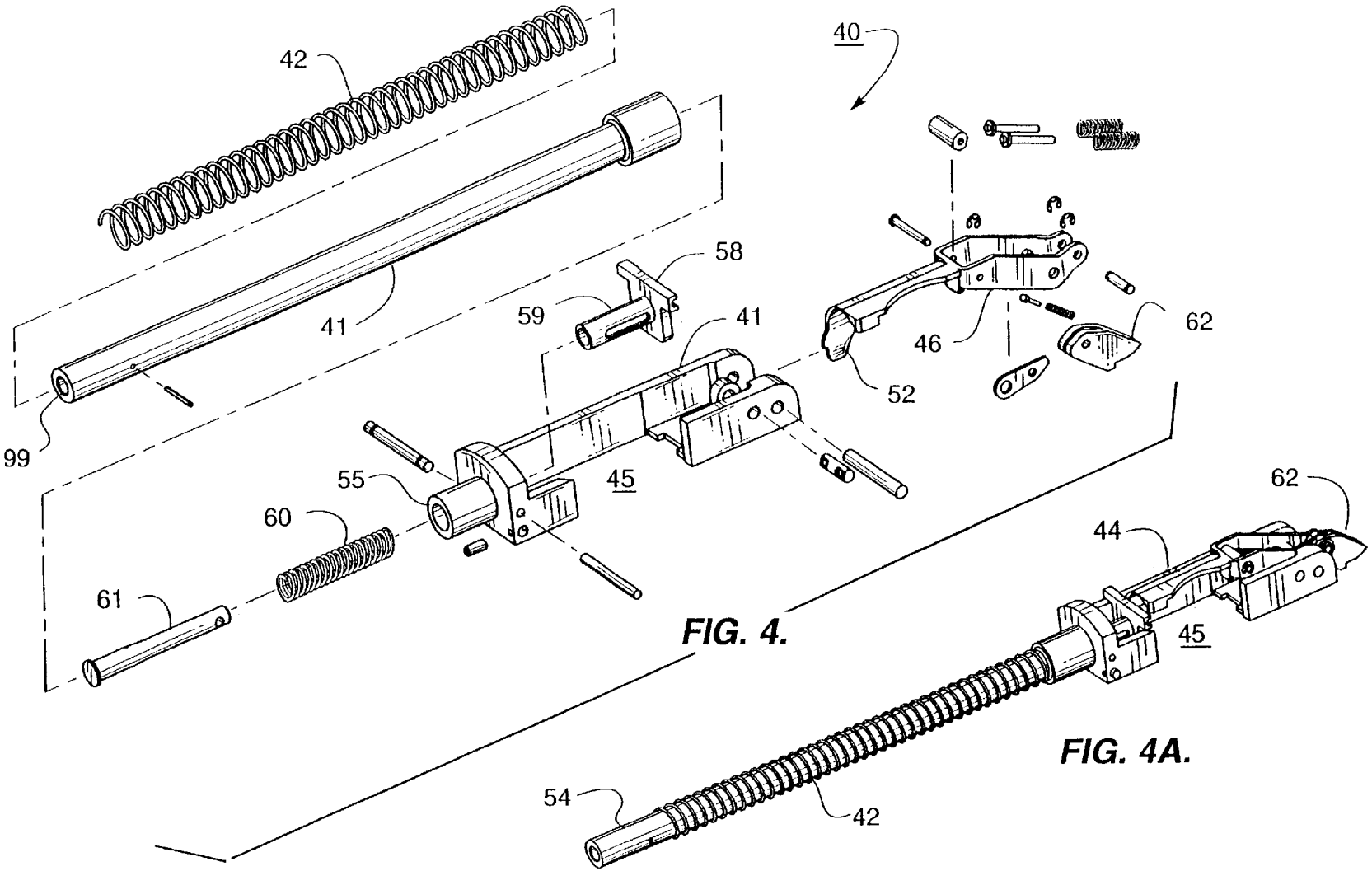
FIG. 4 is an exploded view showing the carrier, recoil tube/spring assembly.
FIG. 4A is a perspective view of the carrier, recoil tube/spring assembly.

Carrier Assembly—FIGS. 4 & 4A

The carrier assembly 40 is shown in FIG. 2 is illustrated and in detail in FIGS. 4 and 4A and includes a carrier frame 44 which defines a carrier shell space 45 which aligns with the loading port 14 and receives the shot shells as they are inserted. A carrier 46 is pivotally secured to the carrier frame and extends forwardly so that the forward end has a downwardly extending tab 52. A recoil tube 41 extends forwardly from the carrier frame being attached to a boss 55 at the forward end of the frame. Recoil spring 42 extends about the recoil tube.

A carrier latch 58 has a short tube 59 slidably received within the boss 55 and positioned at the forward end of carrier space 45 and normally abuts the forward end of the carrier being rearwardly biased by a spring 60 within the boss. The spring is retained by a spring post 61. A dog 62 is pivotally secured to the rear of the carrier 46.

Figure 9:
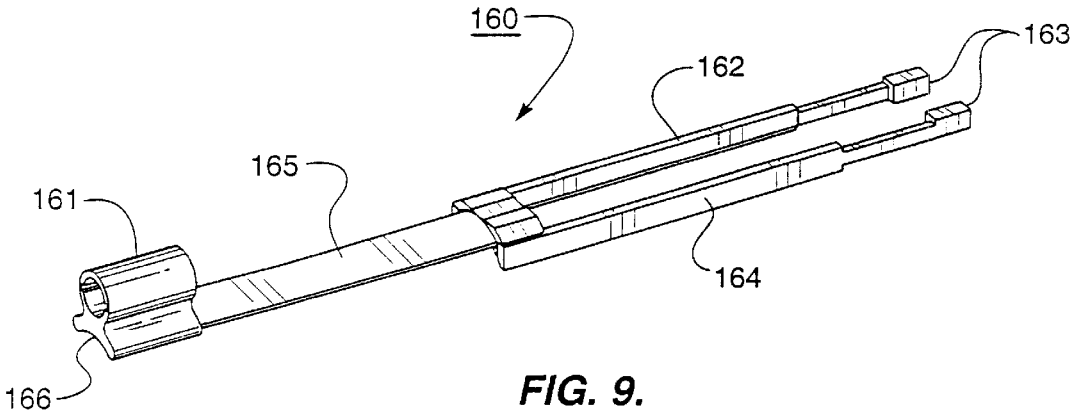
FIG. 9 is a perspective view of the connecting rod assembly.

Connecting Rod Assembly—FIG. 9

The connecting rod assembly 160, as shown in FIG. 9, has a curved body 165 which at its forward end carries a sleeve 161 which extends around the recoil spring and tube. A pair of rearwardly connecting rods 162 and 164 have lugs 163 at their distal ends which are received in recesses 132 at opposite sides of the upper bolt member 102. A follower surface 166 at the forward end of body 165 abuts the gas-operated piston 29 and is driven rearwardly by the piston to compress the recoil spring and, at the same time, cause the rods 162, 164 to drive the upper bolt member rearwardly.

Figure 3:
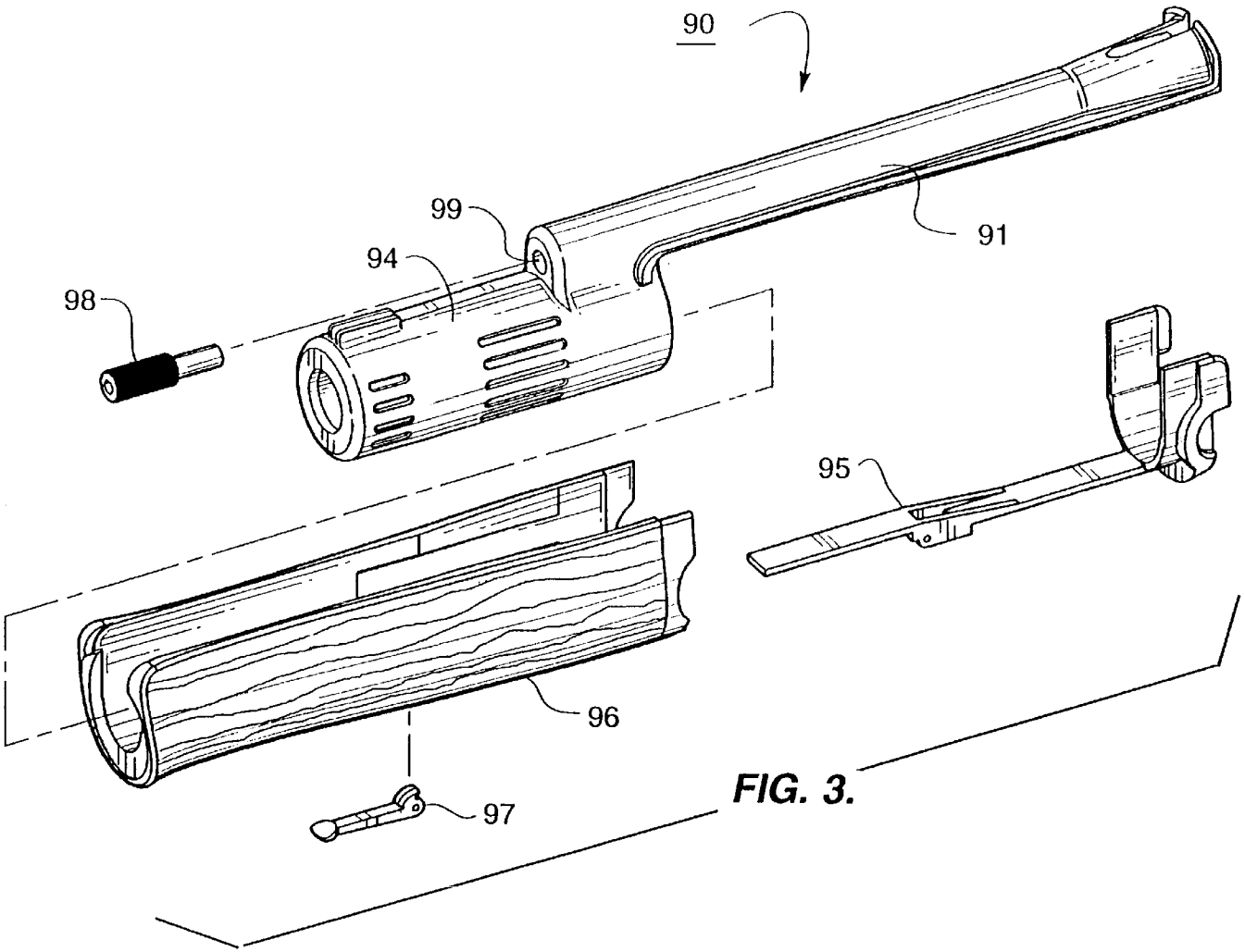
FIG. 3 is an exploded view showing the forearm, forearm frame and gas system cover assembly.

Gas System, Recoil Spring & Tube Cover Assembly—FIG. 3

The gas system, recoil spring and tube cover assembly 90 is shown in FIG. 3 and includes a forearm frame 95 which supports a forearm 96 secured by a latch 97 securable to the forearm frame. Cover 91 has a tubular forward end 94 which extends about the barrel in an area of the gas ports and assists to secure and stabilize the barrel. Expansion springs, not shown, may be provided within the tubular member 94 to assist in maintaining the barrel particularly when the barrel is heated due to repeated firing. Cover 91 is secured into place by bolt 98 inserted through opening 99A in the cover and received in bore 99 in the forward end of the recoil spring tube 41.

Trigger Assembly—FIG. 5, 5A, 5B, 10 and 11

Figure 5:
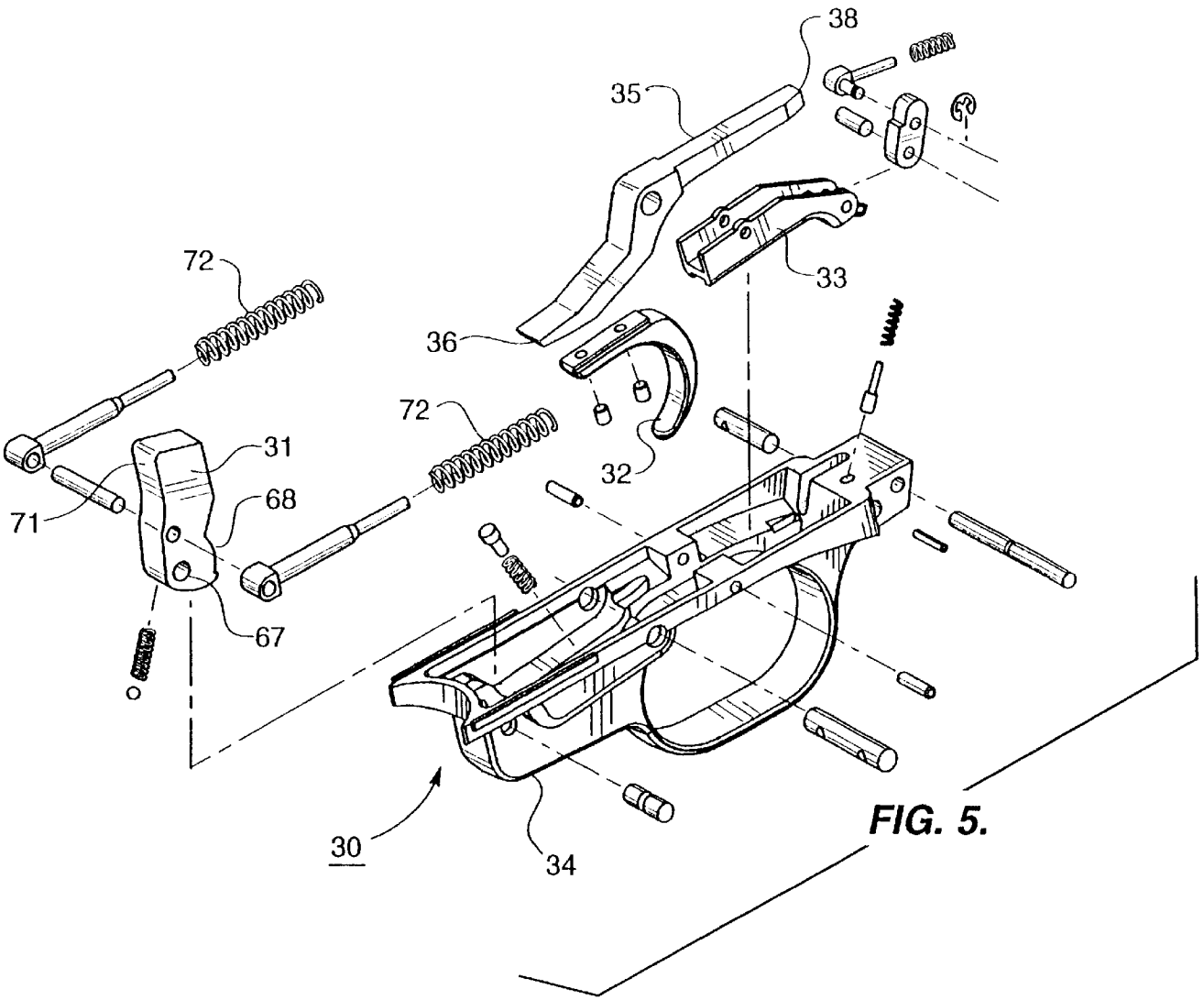
FIG. 5 is an exploded view showing the trigger assembly.
Figure 5A:
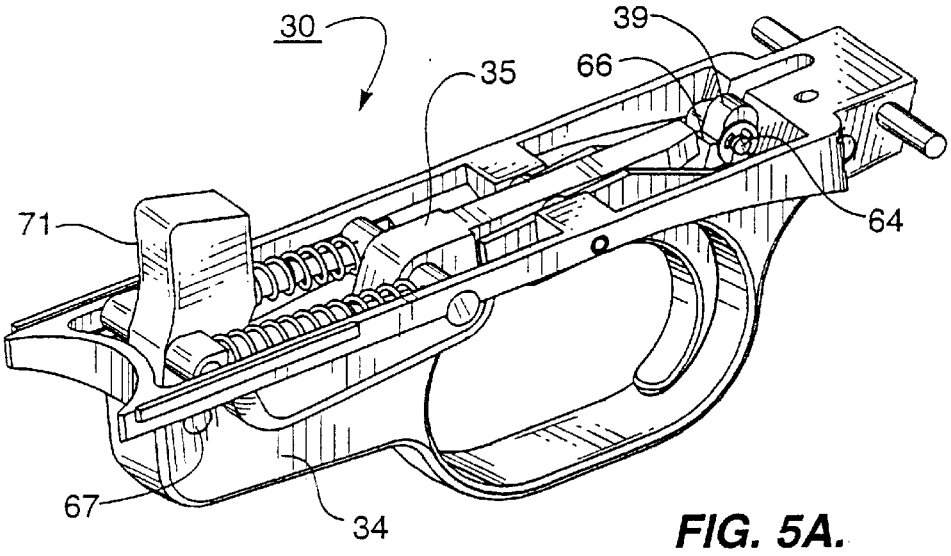
FIG. 5A is a perspective view of the trigger assembly.
Figure 5B:
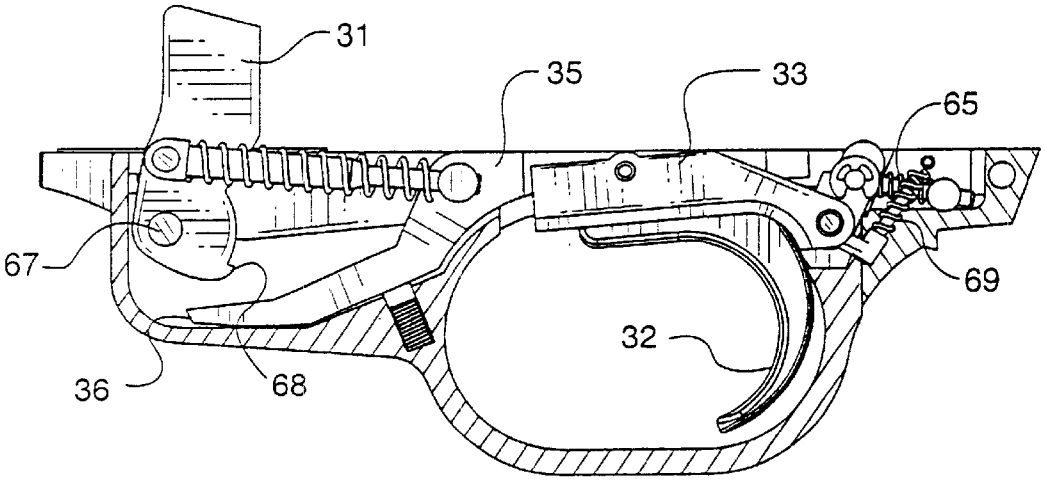
FIG. 5B is a partial sectional view showing the trigger assembly in a fired position.
Figure 10:
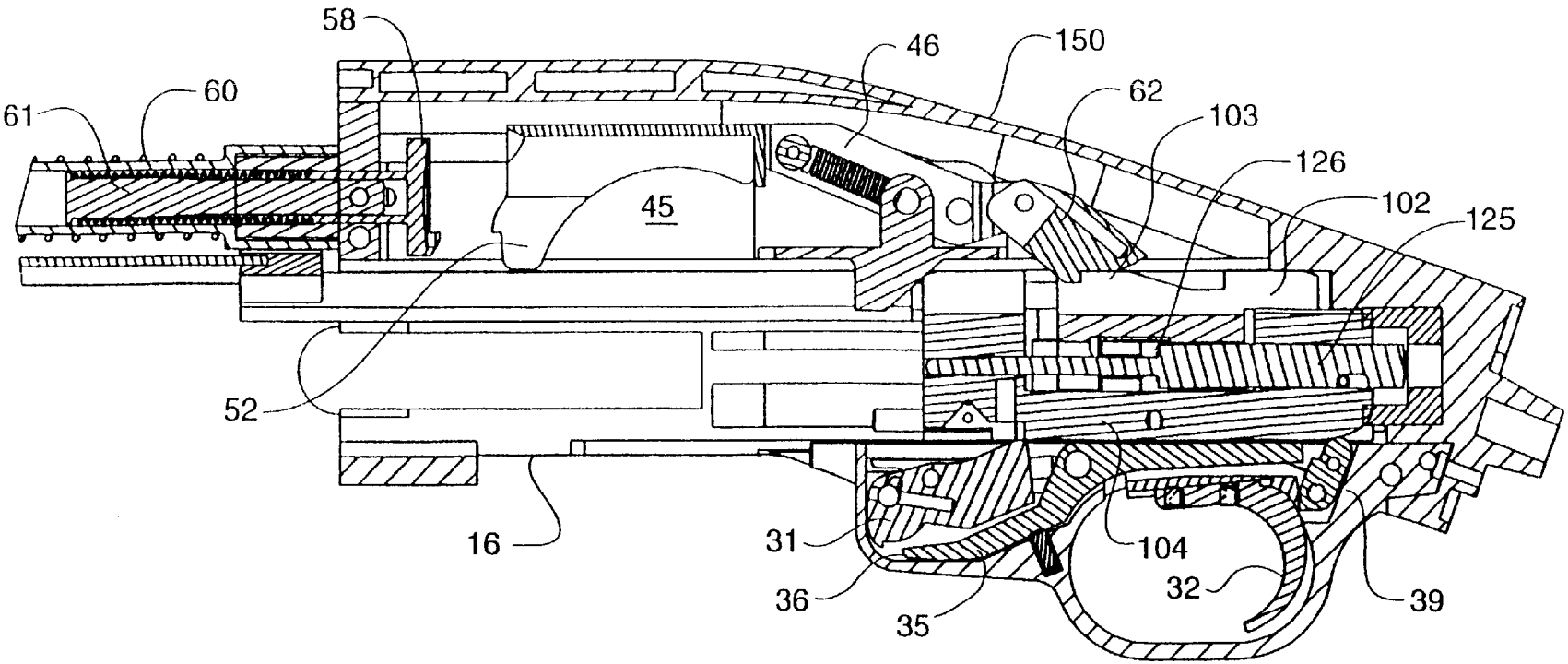
FIG. 10 is a longitudinal cross-sectional view of the receiver showing the bolt in a rear position.
Figure 11:
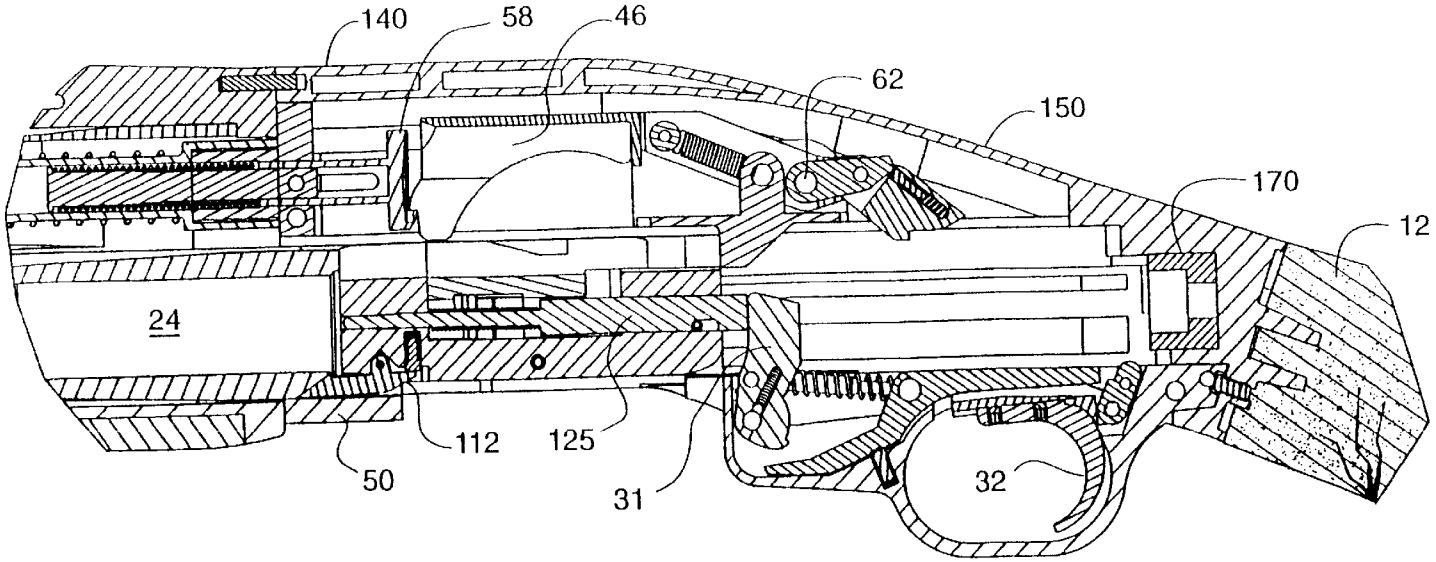
FIG. 11 is a view similar to FIG. 10 with the bolt assembly forward and the hammer impacting the firing pin.

The trigger assembly 30, identified in FIG. 2 by numeral 30, is shown in detail in FIGS. 5 to 5B, as well as FIGS. 10, 11. The trigger assembly 30 includes a trigger frame 34 and a trigger shoe 32. The trigger shoe 32 is secured to the underside of trigger carriage 33 which is pivotally mounted within the trigger frame and is returned by trigger return spring 69. A sear 35 is pivotally mounted to the carriage frame 33 and has an axially extending body which at its forward end defines a lip 36. The rear of the sear 35 defines a cam surface 38. A disconnect link 39 is rotatively mounted at pivot 64 at the rear of the carriage. Disconnect spring 65 normally urges the disconnect rearwardly. A recess or shoulder 66 is formed in forward facing surface of the disconnect 39 as seen in FIGS. 5 and 5A.

Hammer 31 is mounted for pivotal movement about pivot pin 67. The forward surface 71 of the hammer is positioned to strike the firing pin 125 when released. A notch or groove 68 in the rear surface of the hammer is positioned to be engageable with the forward lip 36 on the sear. The hammer is urged forwardly by a pair of hammer springs 72.

It is noted that the entire trigger group and the carrier assembly are separate modular components each consisting of a separate assembly. When the bolt assembly is moved rearwardly after firing a shell, the movement of the lower bolt member 104 will cause the hammer 31 to rotate approximately 90° rearwardly as the bolt member 104 rides over surface 71 of the hammer on its rearward travel. As the bolt assembly returns forward under the force of the recoil spring, the hammer will rotate approximately 45° forward before engaging the sear. At this point, the hammer is in a ready-to-fire position closer to the firing pin for a faster "lock time." The operation of the shotgun is described in greater detail in the Operation section, which follows, and this description will assist in an understanding of the invention and the operation and inter-relationship of the various assemblies or component groups.

Operation

Referring to the drawings, particularly FIGS. 10 and 11, initially to load the shotgun 10, the bolt assembly 100 is drawn rearwardly by the cocking lever 114. The bolt is held in a rearward position by the carrier dog 62 which is in engagement with shoulder 103 on the upper bolt member 102. The rearward movement of the upper bolt member 102 will release the locking lugs 110 forcing them inwardly out of engagement with the seats in member 25, 26. With the bolt in a back position, a shell may be inserted into the loading port 14 into the carrier shell space 45 in the carrier frame. The carrier 46 is in engagement with the lip on the rear of the carrier latch 58. Manually inserting the shell into the magazine will force the latch 58 forwardly against spring 60 allowing the carrier 46 to rotate downwardly which forces the forward end of the inserted shell from the upper position in the magazine 45 toward the breech. The rotation of the carrier 46 also rotates the carrier dog 62 out of engagement with the shoulder 103 of the upper bolt member 102.

The front of the shot shell will strike the barrel extension 50 at the lower edge of the breech and, as the bolt moves forward, the front of the bolt assembly will drive the shell into the breech and also rotate the carrier 46 upward to engage the carrier latch 58. The shell space is empty and can now receive the second shell which is inserted through the loading port 14.

When the trigger shoe 32 is pulled, the trigger carriage 33 is rotated about its pivot point and will "rock" the front of the sear 35 causing lip 36 to disengage from the groove 68 in the hammer 31. This allows the hammer 31 to rotate forwardly under spring force striking the rear of the firing pin 125 driving it into the primer of the shot shell.

As the shell is fired, the ignition creates gas pressure which propels the charge down the barrel past the gas ports 23. The gas will vent through the ports 23 into the gas cylinder chamber of gas housing 28 forcing the piston 29 rearward until it engages the stop 19. As the piston moves, it will hit the surface 166 at the end of the connecting rod assembly 160. The rods 162, 164 will drive the upper bolt member 102 rearward and, as the cam surfaces 118 of the rear of depending legs 116 on the upper bolt strike the lugs 110, the lugs will then be forced to retract from their locked position in engagement with the barrel extensions 50. When the lugs are retracted, the firing pin 125 is prevented from forward movement due to the engagement of the lugs 110 with the shoulder 126 on the firing pin. The movement of the connecting rod assembly also will operate to compress the recoil spring 41.

Upon the upper bolt reaching the end of the slot 134 in the lower bolt, the upper and lower bolt members move rearwardly together. The passage of the lower bolt member above the trigger assembly 30 will rotate the hammer 31 to a near horizontal position. The carrier dog 62 on the carrier assembly will engage the upper side of the upper bolt member restraining it from returning forwardly unless a shell is in the carrier space. The lower bolt 104 strikes a resilient bumper 170 at the rear of the receiver.

The shell guide pins 106, 108 are driven forward as the bolt strikes the rear of the receiver. The grooves 128, 130 in the guide pins, cooperating with detent buttons 131 in the lower bolt member, limit the travel of the pins in both directions. The rearward movement of the bolt engages the extractor 112 and the spent shell casing is discharged out the bottom ejection port 16 in the receiver. The rear of the lower bolt member has now rotated the disconnect link 39 out of engagement with the rear of the sear 35. The return, forward travel of the bolt assembly, allows the disconnect link 39 to engage the rear of the sear maintaining its position. Further forward travel of the upper bolt member will cause the carrier dog 62 to rotate forcing the carrier 46 to rotate to drop the shot shell from the carrier space from the carrier into the breech. The bolt member continues forward until the bolt is in a forward position having positioned the shell in the breech ready for firing. The bolt is locked by the lugs 110 which are forced into a locked position. The hammer is at approximately a 45° position maintained by the front lip 36 of the sear which engages the groove 68 in the hammer. At this point, the shotgun is ready to be fired. If only a single shell is in the breech, the spent cartridge is ejected and the bolt is locked in a rearward position by the carrier dog. It is noted that the shooter may, if desired, insert another shell into the empty magazine which will release the bolt.

Firing is accomplished by applying rearward pressure to the trigger shoe which rotates the trigger carriage disengaging the front of the sear from the hammer allowing the hammer to rapidly pivot forwardly striking the firing pin driving it into the primer firing the shell.

The position of the hammer in the ready-to-fire position reduces travel and the "lock time" required for firing. Once the second shell is fired, the bolt returns to the open position and the shotgun may be reloaded in the manner described above.

Alternate Embodiment Bolt Assembly FIG. 9 13, 14, 15 and 17 to 19

Figure 13:
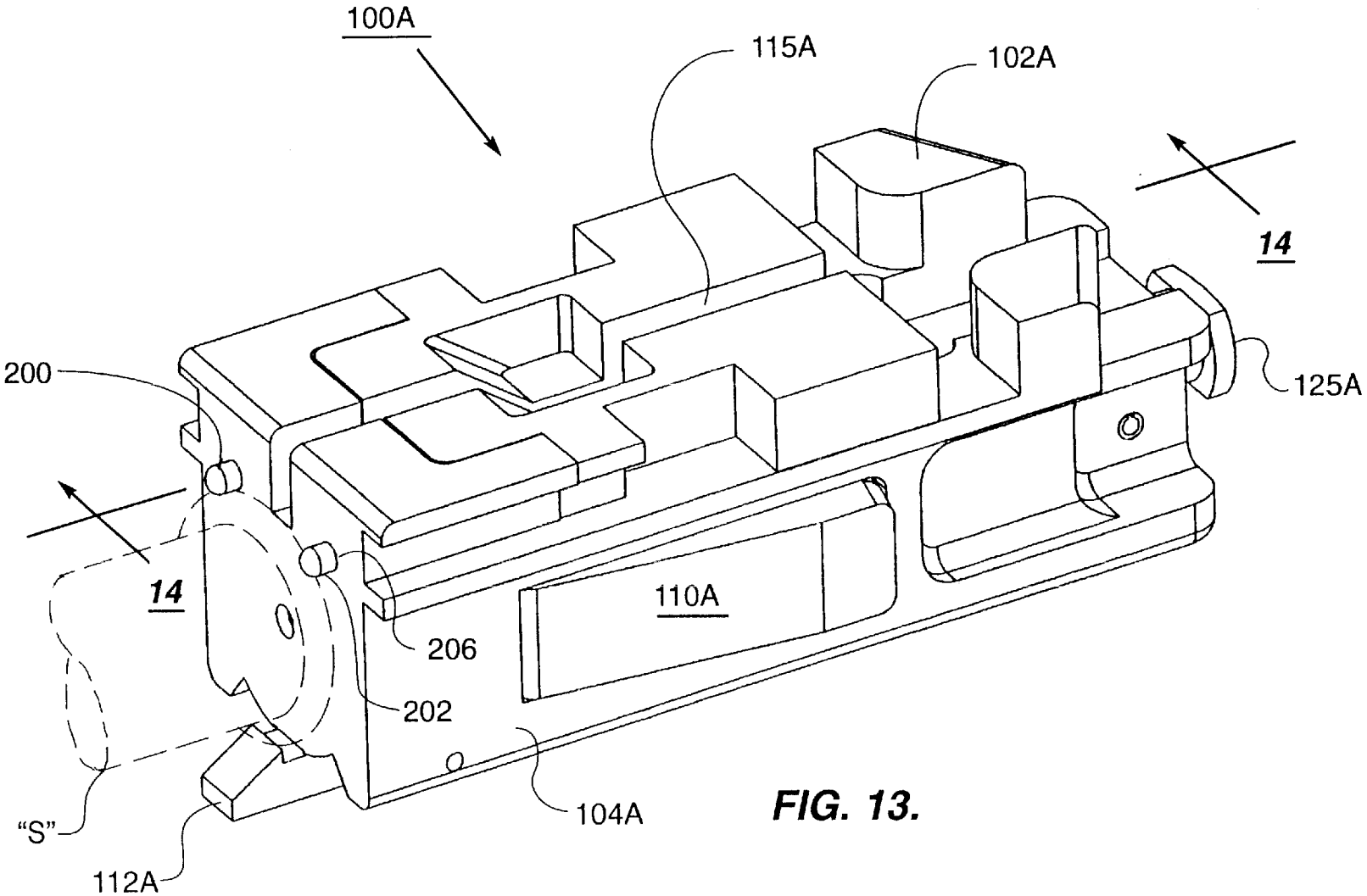
FIG. 13 is a perspective view of an alternate embodiment of the bolt assembly.
Figure 14:
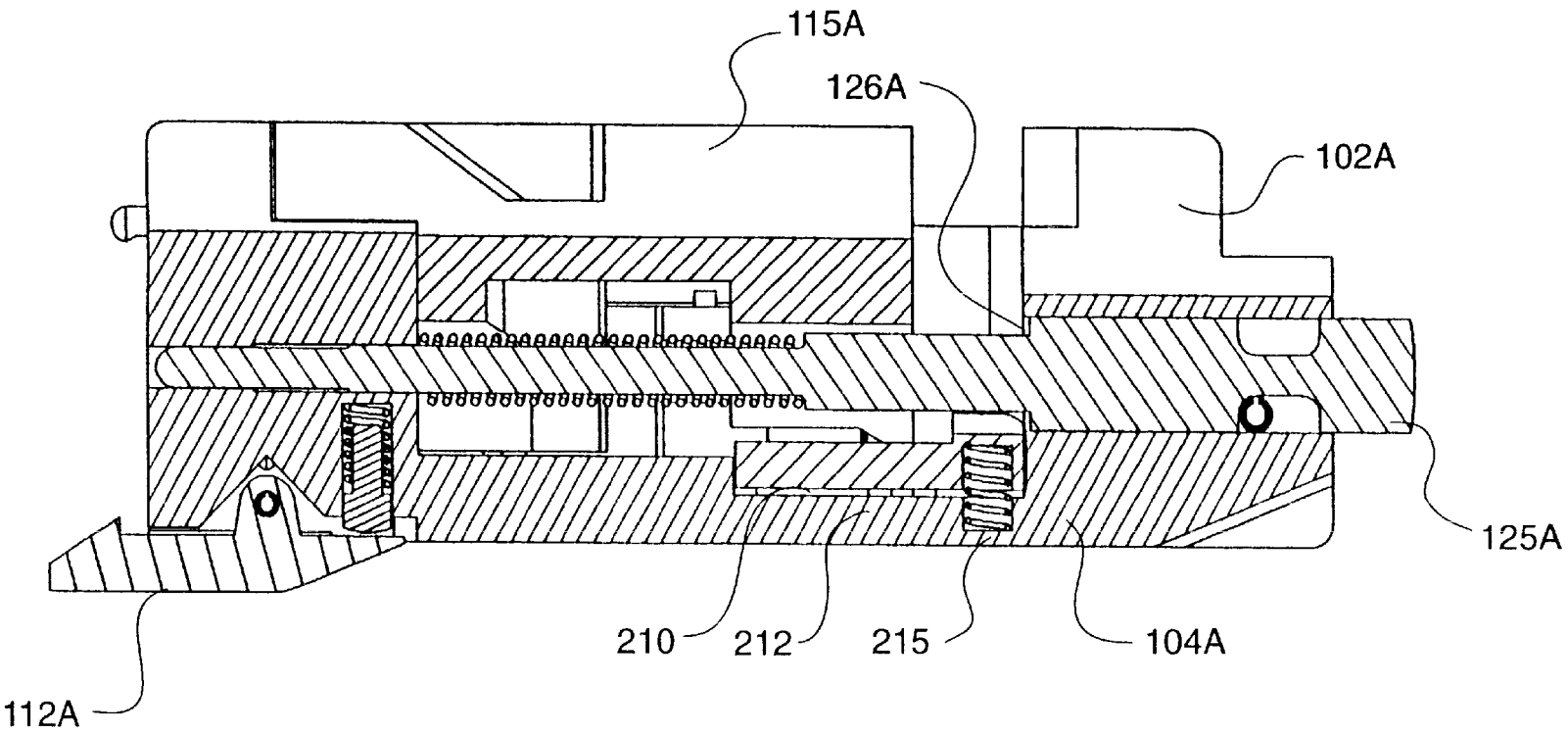
FIG. 14 is a sectional view taken along line 14—14 of FIG. 13.
Figure 15:
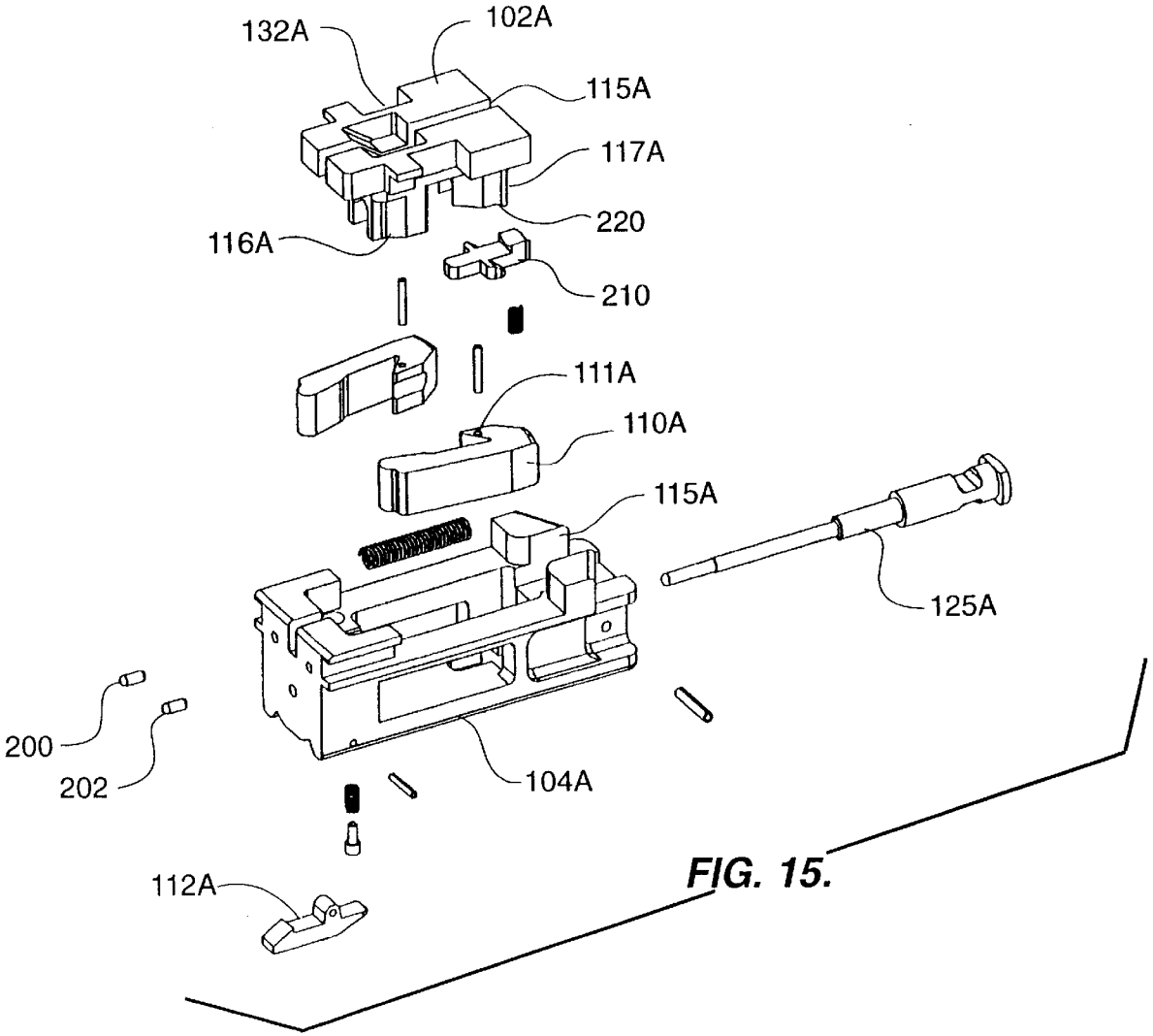
FIG. 15 is a exploded view showing the bolt assembly of FIGS. 13 and 14.
Figure 16:
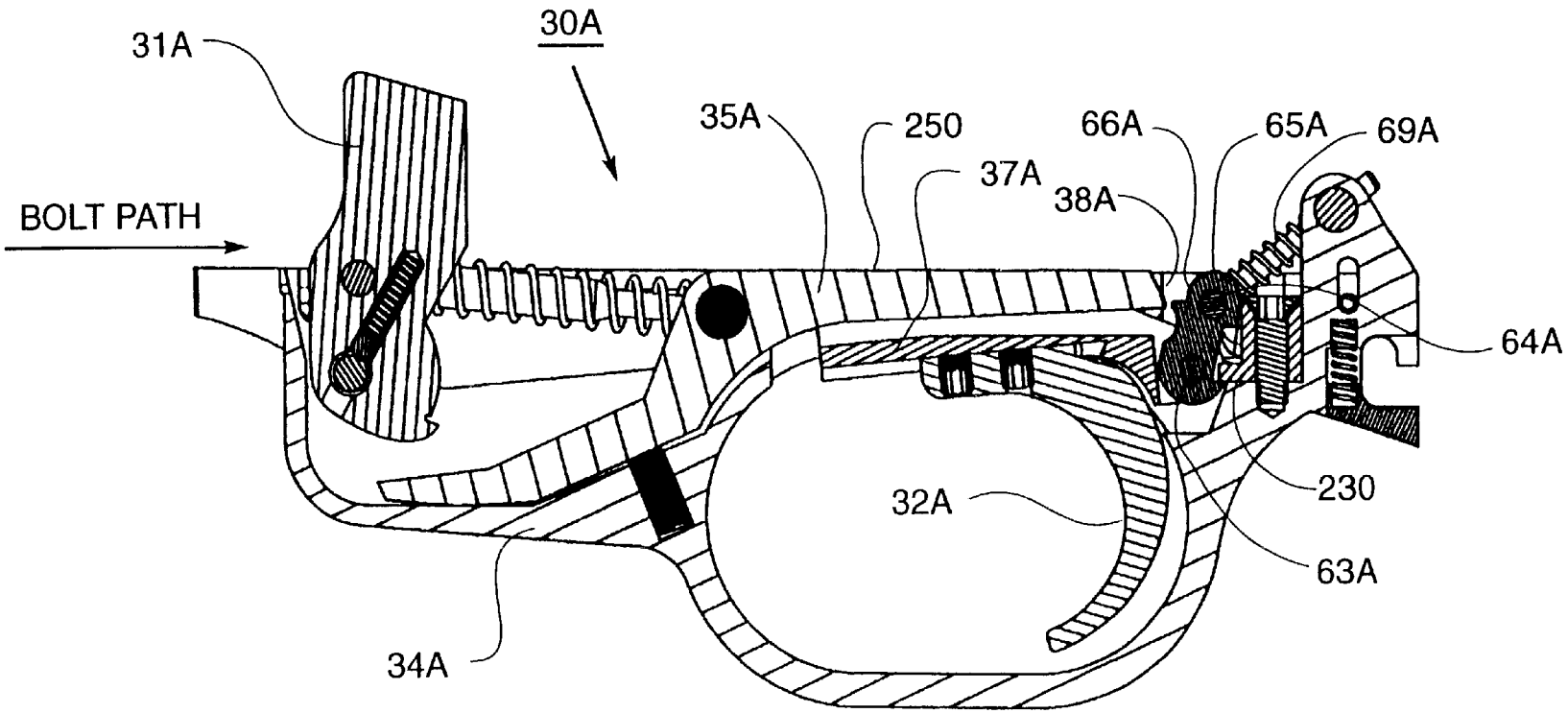
FIG. 16 is a cross-sectional view of the receiver of an alternate embodiment of the trigger assembly.

In FIGS. 13, 14 and 15, an alternate embodiment of the bolt assembly of the present invention is shown and is designated 100A. In describing alternate embodiments, the same numerals have been used to denote the same or similar elements as described above with an appended letter "A." The assembly again includes an upper bolt member 102A and a lower bolt member 104A which operate as described above. A firing pin 125A has a shoulder 126A at an intermediate location and is driven forwardly by the hammer.

A pair of locking lugs 110A are pivotally mounted at 111 in recesses in the opposite sides of the lower bolt member. Extractor 112A is pivotally mounted to the lower side of the lower bolt.

The upper bolt member defines a longitudinal slot 115A extending along its upper surface and carries depending legs 116A, 117A.

Recesses 132A in the opposite sides of the upper bolt receive the ends of the connecting rods 162, 164, previously described. The shell "S," shown in dotted lines in FIG. 13, is retained by shell retaining pins 200, 202 which project forwardly from the face of the lower bolt and are spaced-apart and located to engage the rim of the shell base. The pins 200, 202 may be provided with a notch or undercut 206 to accommodate the shell rim. The portion of the shell rim opposite the pins is engaged by the extractor 112A.

The operation of the bolt, as has been described above with the exception that the retainer pins along with the extractor 112A will serve to engage and withdraw the spent shell as the bolt moves rearwardly. The extractor will discharge the shell casing out the bottom ejection port when the shell casing strikes the ejector.

Figure 17:
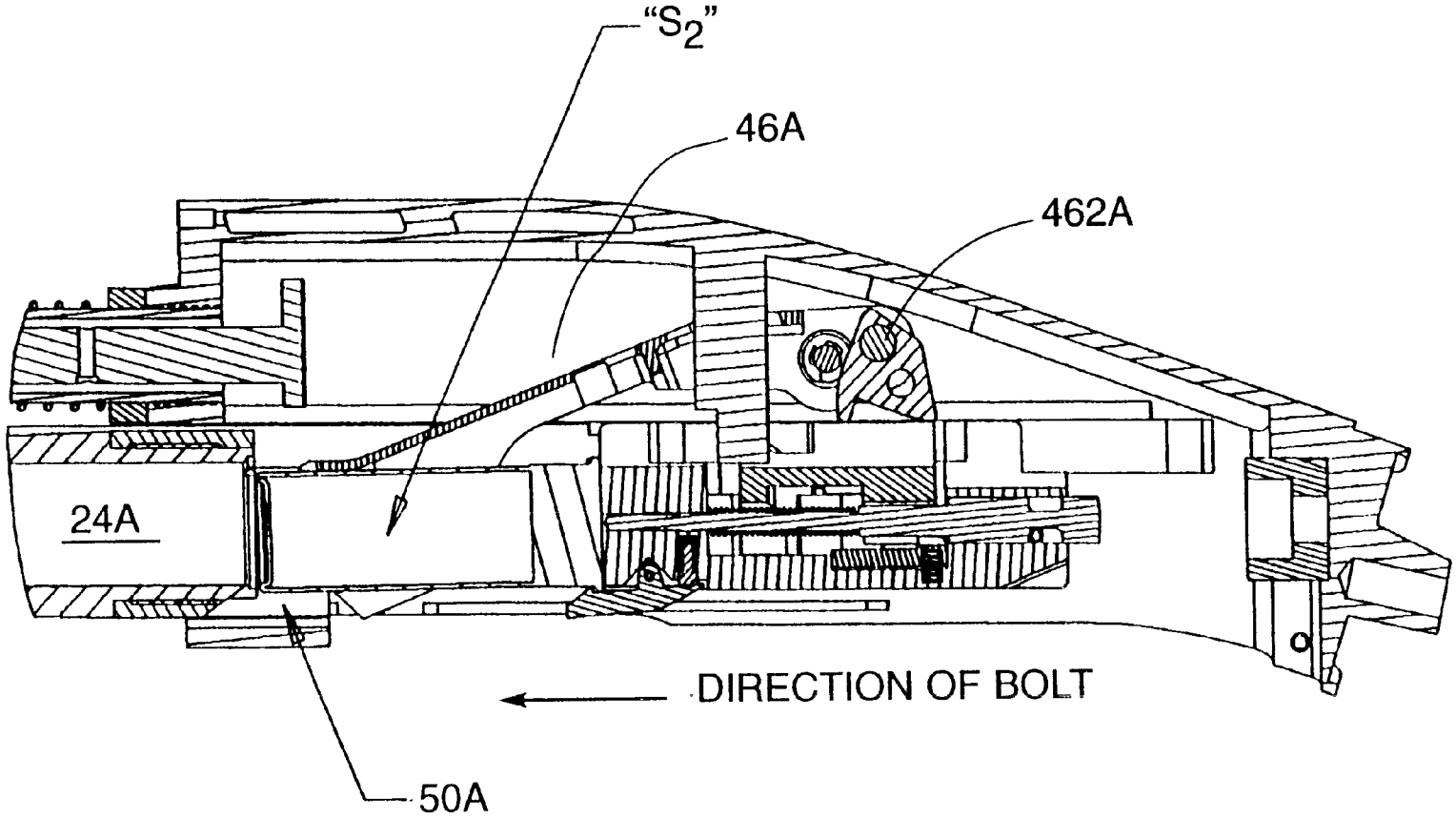
FIG. 17 is a cross-sectional view of the receiver incorporating the bolt assembly of FIG. 13 with a shell being loaded.

Referring to FIG. 17, a shell "S" is shown being advanced into the breech by the bolt. The carrier engages the shell and the front end of the shell rests on the barrel extensions 50A. The carrier 46A has been rotated downwardly by the carrier dog 62A engaging the upper surface of bolt 102A. The shell is prevented from falling down and through the ejection port by the barrel extensions 50A and is guided by the barrel extensions 50A, which are spaced-apart projections at the bottom of the breech 24A, in the area between the locking lug seats 25, 26 as seen in FIGS. 6 and 6A.

Figure 18:
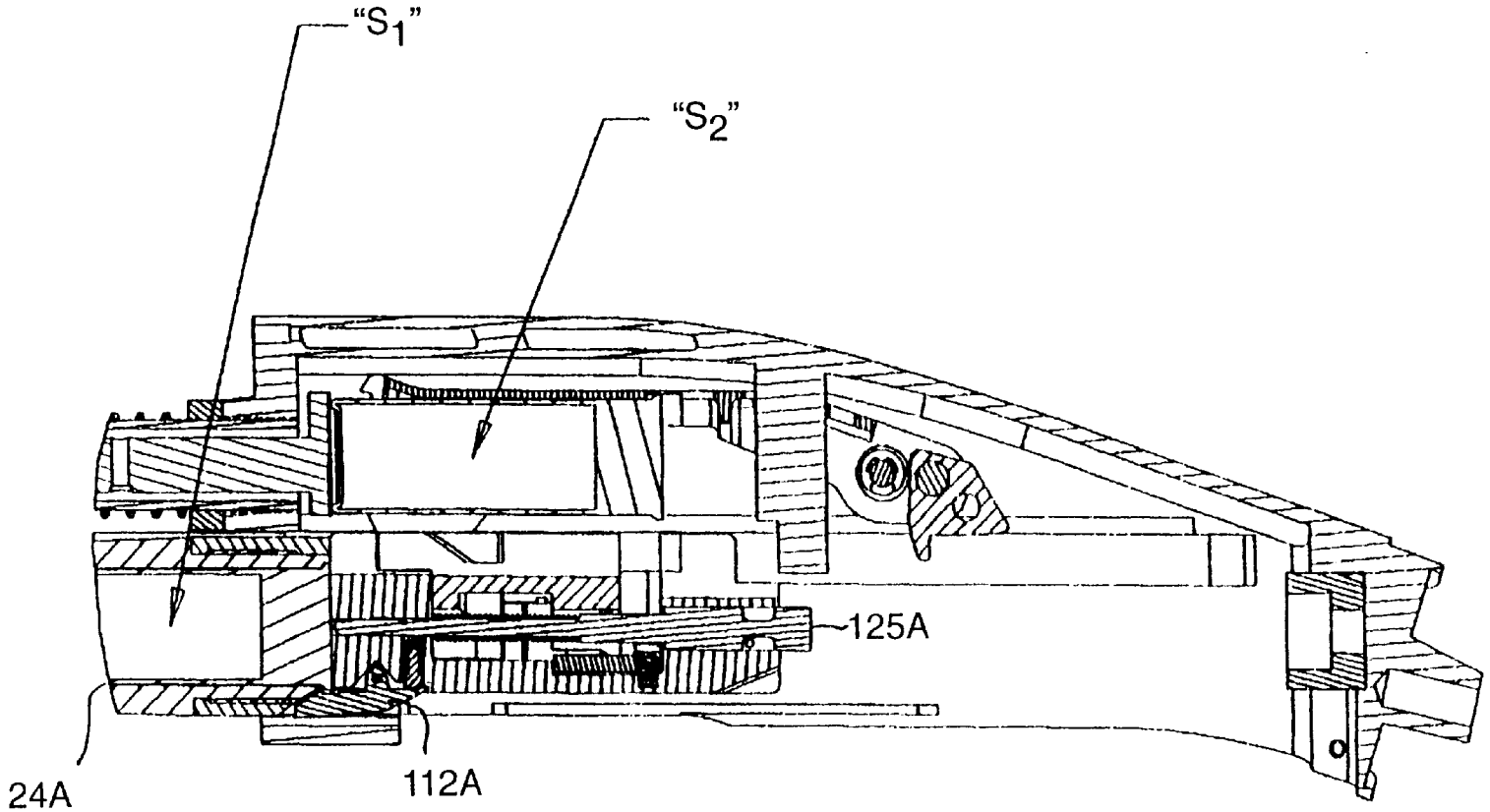
FIG. 18 is a view similar to FIG. 17 showing an unfired shell in the chamber.

In FIG. 18, the unfired shell "S1" is fully inserted in the breech 24A in a ready-to-fire position. The firing pin 125A is positioned to be driven forward by the hammer, not shown. The extractor 112A is in engagement with the rim of the base of the shell "S1."

Figure 19:
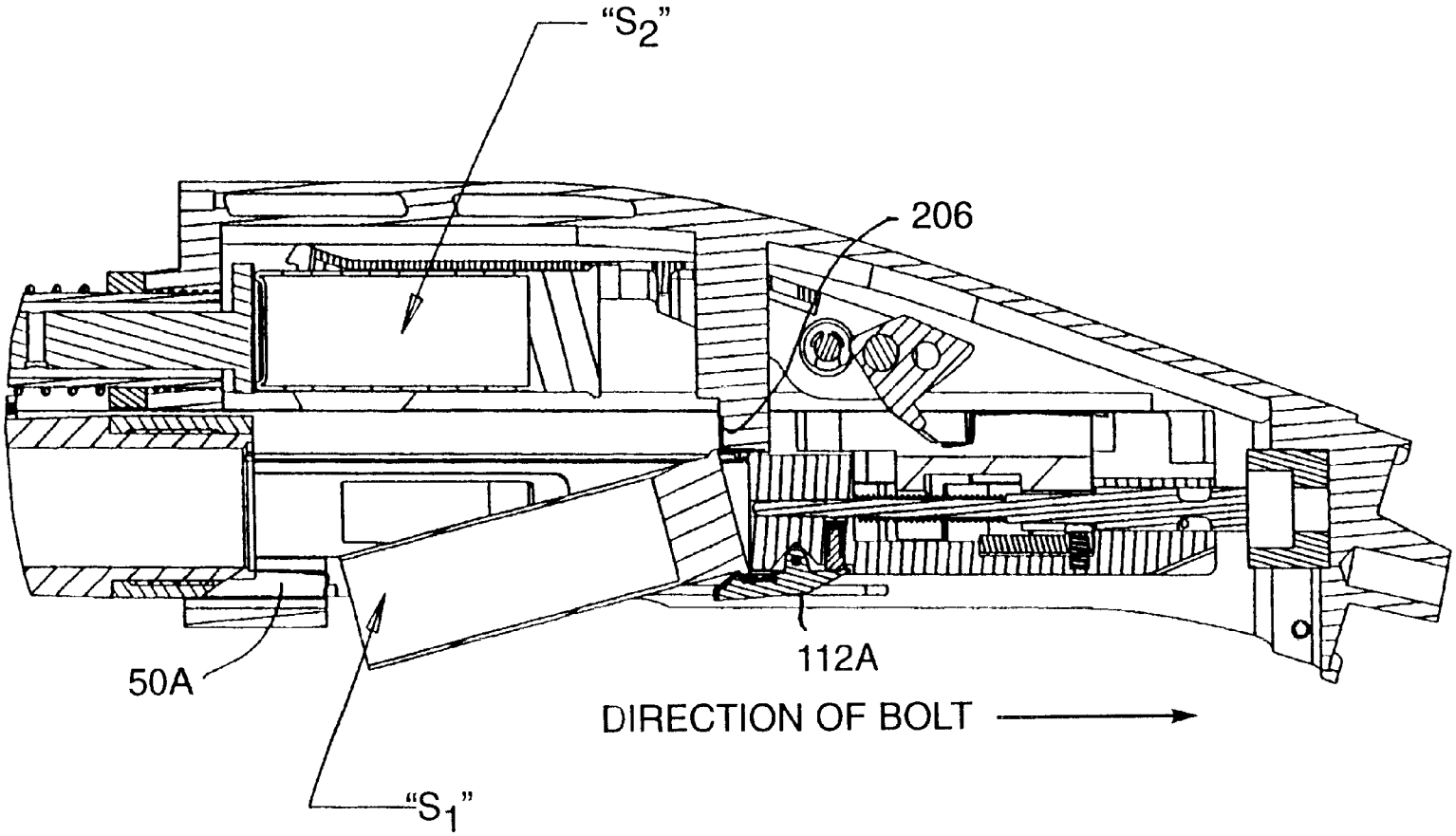
FIG. 19 is a view similar to FIG. 17 illustrating the ejection of a shell after firing.

In FIG. 19, the shell "S1" is shown as being ejected through the lower ejection portion having been moved rearward by the bolt, bolt retainer pins 200, 202 and extractor 112A. As the shell "S1" clears the barrel extensions 50A, the base of the shell strikes the ejector surface 206 causing the shell to be pivoted downwardly through the lower ejection port as shown in FIG. 19. The return forward motion of the bolt will cause the unfired shell "S2" to be directed downwardly into the breech as described above with reference to FIG. 17.

A firing pin lock 210 is positioned in a recess 212 in the lower bolt 104A and is urged upwardly by a spring 215, as best seen in FIG. 14. In the position shown in FIG. 14, the lock 210 engages the shoulder 126A on the firing pin 125A preventing it from moving further forward to a firing position. The lock 210 is held in this position until released by a lip or cam surface 220 on the depending rear legs 117A of the upper bolt seen in FIG. 15. This occurs only after the locking lugs 110A and the lower bolt 104A are substantially fully engaged in the locking lug seats 25, 26 on the rear of the barrel. Thus, a shell not properly seated in the barrel breech chamber 24A due to dirt, improper shell size or other impediment, cannot be fired as the obstacle will prevent the bolt from positioning as the top bolt cannot move fully forward.

Alternative Embodiment of Trigger Assembly

FIG. 16

Another significant advantage of the design is the modular trigger assembly in which all components, when in at least one operational position, are located at or below the upper edge of the assembly and out of the way of the rearward bolt travel.

The trigger assembly 30A includes a trigger frame 34A and trigger shoe 32A. The shoe is secured to a trigger carriage 33A. Sear 35A is pivotally mounted to the carriage 33A.

The sear 35A has lip 36A at its forward end and cam surface 38A at its rear. Disconnect link 65A is rotative about pivot 65A and is urged forwardly and downwardly by spring 69A. A recess or shoulder 66A is provided in the face of the disconnect 65A.

A fixed shoulder 230 is located adjacent the disconnect. Shoulder 230 will engage the disconnect and will assist to return the disconnect to a position under the rear of the sear.

When pressure is applied to the trigger shoe, the shoe rotates the trigger carriage and disconnect disengaging the front of the sear from the hammer. This action trips the disconnect rearwardly allowing the sear to drop into a rest position. The shoulder 230 assists in forcing the disconnect to a position under and engaging the sear.

It will be noted that when the hammer 31A is fully rotated rearwardly, all components in the path of the bolt travel are positioned in an out-of-the-way position so as to not obstruct or interfere with the bolt. Also the entire trigger assembly 30A is modular for convenience of installation, maintenance and replacement as necessary.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A semi-automatic shotgun comprising:

(a) a barrel having a bore with a breech at its proximal end and having seat-defining projections extending rearwardly from the breech, said barrel having a gas port at a location along the bore communicating with a gas cylinder having a piston;

(b) a receiver having a side loading port and a bottom ejection port, said receiver receiving said barrel and a stock;

(c) a connecting rod assembly extending along said barrel operably driven by said piston, said connecting rod assembly having an axially extending connecting rod;

(d) a carrier assembly having a recoil spring movable to a compressed position by said connecting rod assembly, said carrier assembly defining a shell receiving space and including a carrier arm pivotally secured thereto;

(e) a bolt assembly having an upper bolt member and a lower bolt member, said lower bolt member having a face and receiving a firing pin, locking lugs associated with said lower bolt member, said locking lugs being engageable in said barrel seat defining projections when said lower bolt is in a forward position, said upper bolt member being operably connected to said connecting rod and moveable relative to said lower bolt member whereby rearward movement of said connecting rod will move said upper bolt to release said lugs allowing said lower bolt to move rearward to a position to engage a shell dropped from the carrier assembly; and (f) a trigger assembly including a trigger shoe, sear and a trigger carriage operationally connected to a hammer, said hammer being moved rearwardly by said lower bolt and returned to a ready-to-fire position by the sear.

2. The shotgun of claim 1 wherein said barrel is a lower barrel.

3. The shotgun of claim 1 wherein said gas port comprises a plurality of ports circumferentially about the barrel at an intermediate location.

4. The shotgun of claim 1 wherein said trigger assembly and said carrier assembly are each separate modular components.

5. The shotgun of claim 1 wherein said upper bolt member is slidable between a forward and a rearward position, said upper bolt member being driven rearwardly by said connecting red assembly to said rearward position in which said upper and lower bolt members move together to a full rearward position striking a surface of the receiver.

6. The shotgun of claim 1 wherein said trigger assembly comprises:

(a) a trigger frame;

(b) a trigger carriage pivotally mounted to said frame;

(c) a trigger shoe on said carriage;

(d) a sear pivotally secured to said trigger frame, said sear having a rear and forward end;

(e) a disconnect link pivotally mounted to the rear of the carriage frame;

(f) a hammer pivotally mounted to said trigger frame; and (g) whereby said hammer is pivoted rearwardly by said bolt, said hammer being returned to a ready-to-fire position angularly disposed relative to a firing pin by said sear and is released upon pressure being applied to said trigger shoe.

7. The shotgun of claim 6 wherein said trigger assembly further includes a surface engageable with said disconnect to return said disconnect into position against the sear after firing.

8. The shotgun of claim 5 further including a safety lock associated with said bolt assembly engaging said firing pin and release means operable to disengage said safety lock only when said bolt assembly is in a proper firing position.

9. The shotgun of claim 1 wherein said lower bolt member includes shell retaining means on said face engageable with the base of a shell and an extractor which cooperate to engage and withdraw a spent shell as the bolt assembly moves rearwardly after firing.

10. The shotgun of claim 9 further including means for ejecting a spent shell.

11. The shotgun of claim 1 wherein said barrel is provided with a barrel extension in the breech area to prevent the shell from falling through the bottom ejection port upon loading and to guide a shell into the breech.

12. The shotgun of claim 11 wherein said seat-defining projections are located at opposite sides of the barrel and said barrel extension is located on the bottom of the barrel intermediate said seat-defining projections.

13. A semi-automatic shotgun comprising:

(a) a barrel having a bore with a breech at its proximal end and having seat-defining projections extending rearwardly from the breech, said barrel having a gas port at a location along the bore communicating with a gas cylinder having a piston;

(b) a receiver having a side loading port and a bottom ejection port, said receiver receiving said barrel and a stock;

(c) a connecting rod assembly extending along said barrel operably driven by said piston, said connecting rod assembly having an axially extending connecting rod;

(d) a carrier assembly having a recoil spring movable to a compressed position by said connecting rod assembly, said carrier assembly defining a shell receiving space and including a carrier arm pivotally secured thereto;

(e) a bolt having a face and receiving a firing pin and locking lugs associated with said bolt, said locking lugs being engageable in said barrel seat defining projections when said bolt is in a forward position, said bolt being operably connected to said connecting rods and whereby rearward movement of said connecting rods will move said bolt to release said lugs allowing said bolt to move rearward to a position to engage a shell dropped from the carrier assembly; and (f) a trigger assembly including a trigger shoe, sear and a trigger carriage operationally connected to a hammer, said hammer being moved rearwardly by said bolt and returned to a ready-to-fire position by the sear.

* * * * *